United States Patent [19]

Virtanen

[11] Patent Number: 4,865,887

[45] Date of Patent: Sep. 12, 1989

[54] PROCEDURE FOR THE PRODUCTION OF CONCRETE ELEMENTS

[75] Inventor: Olli Virtanen, Parainen, Finland

[73] Assignee: Oy Lohja AB, Virkkala, Finland

[21] Appl. No.: 192,004

[22] Filed: May 9, 1988

[30] Foreign Application Priority Data

May 21, 1987 [FI] Finland ..... 872244

[51] Int. Cl.[4] ..... B05B 3/18; B05C 11/02; B05D 1/02; B05D 3/12

[52] U.S. Cl. ..... 427/356; 118/111; 118/323; 264/71; 264/256; 264/259; 264/309; 427/368; 427/424; 427/427

[58] Field of Search ..... 425/470, 471; 264/71, 264/308, 309, 162, 163, 139, DIG. 72, 256, 259; 427/355, 356, 359, 368, 424, 427; 118/323, 111

[56] References Cited

U.S. PATENT DOCUMENTS

| | | | |
|---|---|---|---|
| Re. 27,109 | 3/1971 | Videen | 264/162 X |
| 1,648,874 | 11/1927 | Delaney | 264/309 X |
| 2,187,223 | 1/1940 | Cory | 264/309 X |
| 2,187,224 | 1/1940 | Cory | 246/71 X |
| 2,262,899 | 11/1941 | Mechlin | 264/309 X |
| 2,522,593 | 9/1950 | Anderson | 425/470 X |
| 2,543,517 | 12/1951 | Anderson | 239/602 |
| 2,777,419 | 1/1957 | Paasche | 118/323 |
| 2,778,088 | 1/1957 | Sterrett | 264/162 |
| 2,892,239 | 6/1959 | Neff | 264/309 X |
| 2,900,950 | 8/1959 | Peeps | 118/323 X |
| 2,964,821 | 12/1960 | Meehan | 264/256 X |
| 3,009,209 | 11/1961 | Weinbrenner et al. | 264/DIG. 72 X |
| 3,184,328 | 5/1965 | Wagner et al. | 427/424 |
| 3,619,311 | 11/1971 | Rose et al. | 427/424 X |
| 3,622,656 | 11/1971 | Dewey, Jr. et al. | 264/309 X |
| 3,776,990 | 12/1974 | Watkins, Jr. et al. | 264/308 X |
| 3,793,428 | 2/1974 | Gordon | 264/DIG. 72 X |
| 3,914,077 | 10/1975 | Lodes | 425/470 X |
| 4,042,734 | 8/1977 | Wiggins | 427/424 |
| 4,047,967 | 9/1977 | Majidzadeh | 106/90 |
| 4,181,093 | 1/1980 | Tredwell | 118/323 |
| 4,279,215 | 7/1981 | Schäfer | 427/424 X |
| 4,417,541 | 11/1983 | Schäfer | 118/323 X |
| 4,454,702 | 1/1984 | Bonilla-Lugo et al. . | |
| 4,514,347 | 4/1985 | Reed | 264/162 X |
| 4,565,661 | 1/1986 | Michienzi | 264/35 X |
| 4,678,157 | 7/1987 | Fondiller | 264/309 X |
| 4,743,414 | 5/1988 | Sudrabin | 264/256 X |
| 4,785,760 | 11/1988 | Tholome | 118/323 |

FOREIGN PATENT DOCUMENTS

| | | | |
|---|---|---|---|
| 251022 | 12/1966 | Austria . | |
| 1167073 | 5/1984 | Canada . | |
| 0056146 | 7/1982 | European Pat. Off. . | |
| 435567 | 10/1926 | Fed. Rep. of Germany . | |
| 2165889 | 6/1973 | Fed. Rep. of Germany . | |
| 2166509 | 7/1974 | Fed. Rep. of Germany . | |
| 3533476 | 6/1986 | Fed. Rep. of Germany . | |
| 1360803 | 7/1974 | United Kingdom | 264/309 |
| 1368912 | 10/1974 | United Kingdom . | |
| 2046339 | 11/1980 | United Kingdom | 264/309 |
| 2155389 | 9/1985 | United Kingdom | 264/309 |

*Primary Examiner*—Jan H. Silbaugh
*Assistant Examiner*—Karen D. Kutach
*Attorney, Agent, or Firm*—Kane, Dalsimer, Sullivan, Kurucz, Levy, Eisele & Richard

[57] ABSTRACT

A method for fabricating concrete structural elements is shown. According to the method, a structural element, such as a sheet of insulating material reinforced with concrete, is vertically oriented and coated with fresh concrete sprayed by a shotcrete gun. This coating is then smoothed and shaped as required by the given application. The method does not require the use of moulds to cast the structural element, whose surface is therefore visible at all times during the course of manufacture. This allows for the repair of imperfections before the concrete has hardened.

9 Claims, 3 Drawing Sheets

PROCEDURE FOR THE PRODUCTION OF CONCRETE ELEMENTS

FIELD OF THE INVENTION

The present invention relates to a procedure for the production of concrete elements, whereby the element is shotcreted using a shotcrete gun.

DESCRIPTION OF THE PRIOR ART

In current practice, the concrete elements needed for building purposes are cast in various moulds. The moulds, which are usually held in a horizontal position, are filled with fresh concrete, which is then allowed to harden in the mould. The necessary reinforcements and isolation materials are placed in the moulds either before or during the casting operation.

SUMMARY OF THE INVENTION

The object of the present invention is to achieve a new type of procedure for the production of concrete elements. The procedure of the invention is characterized in that a vertically placed wal structure, such as a sheet or board of insulating material with concrete reinforcement, is shotcreted. The invention renders casting moulds superfluous, because a sufficiently even concrete layer of the desired thickness can be formed directly on the vertical wall structure. The element can be easily moved and manipulated when the concrete is still fresh, because it is light and no moulds are needed. The surface of the element is visible all the time, so that any defects can be easily mended. The surface of a casting in a mould cannot be seen and defects are always more difficult to repair after the element has been removed from the mould.

A preferred embodiment of the invention is characterized in that the wall structure, suspended from rails by means of supporting arms, is moved along the rails at the same time when it is shotcreted by a shotcrete gun moving in the vertical direction. Thus the wall structure can be easily moved back and forth while the shotcrete gun advances from the bottom edge upwards, so that an even concrete layer of the desired thickness is formed. The supporting arms are detached from the element and used again.

Another embodiment of the invention is characterized in that the shotcrete gun is moved on separate rails running in a direction perpendicular to the direction of movement of the wall structure. The shotcrete gun being movable in this manner, the distance to the wall structure is short, which makes it possible to use very stiff fresh concrete that will stick to the wall structure without dripping off. Previously known shotcrete guns use very loose fresh concrete because they need hoses to transfer it to the target.

A preferred embodiment of the invention is further characterized in that, after the element has been shotcreted, the concrete surface is smoothed by mechanical means, i.e. treated with an incisor which is moved in the vertical direction e.g. at the same time when the element is moving in the horizontal direction.

A preferred embodiment of the invention is further characterized in that the concrete surface is smoothed by mechanical means, i.e. treated with a lapping disc rotating around its axis, the disc being likewise moved up and down as the element is moving back and forth.

A preferred embodiment of the invention is further characterized in that the concrete surface is smoothed by mechanical means, i.e. treated with a brush moving up and down as the element is moving back and forth.

With all the above-mentioned embodiments designed for finishing treatment, the desired appearance of the concrete surface can be achieved by simple means, because the surface is sufficiently fresh immediately after the shotcreting.

A preferred embodiment of the invention is further characterized in that a conveyor is provided below the element to collect and remove the extra concrete falling down during shotcreting or surface treatment. The amount of this extra concrete accumulated during the treatment is fairly large, so it can be removed with a belt conveyor and reused while it is still fresh.

A preferred embodiment of the invention is further characterized in that the incisor consists of a tightened band or wire which is vibrated and/or run around a continuous track as in a bandsaw when the concrete surface is being cut. In this manner, the whole surface of the element can be evened with a single operation.

A preferred embodiment of the invention is further characterized in that the form of the cutting edge of the incisor is adjusted by means of intermediate supports to produce different shapes. Thus the concrete surface can be shaped in various ways and even a round column can be given the desired appearance and form.

BRIEF DESCRIPTION OF THE DRAWINGS

In the following, the invention is described by the aid of an example, reference being made to the drawings attached, wherein.

DETAILED DESCRIPTION OF THE PREFERRED EMBODIMENTS

Figure 1:
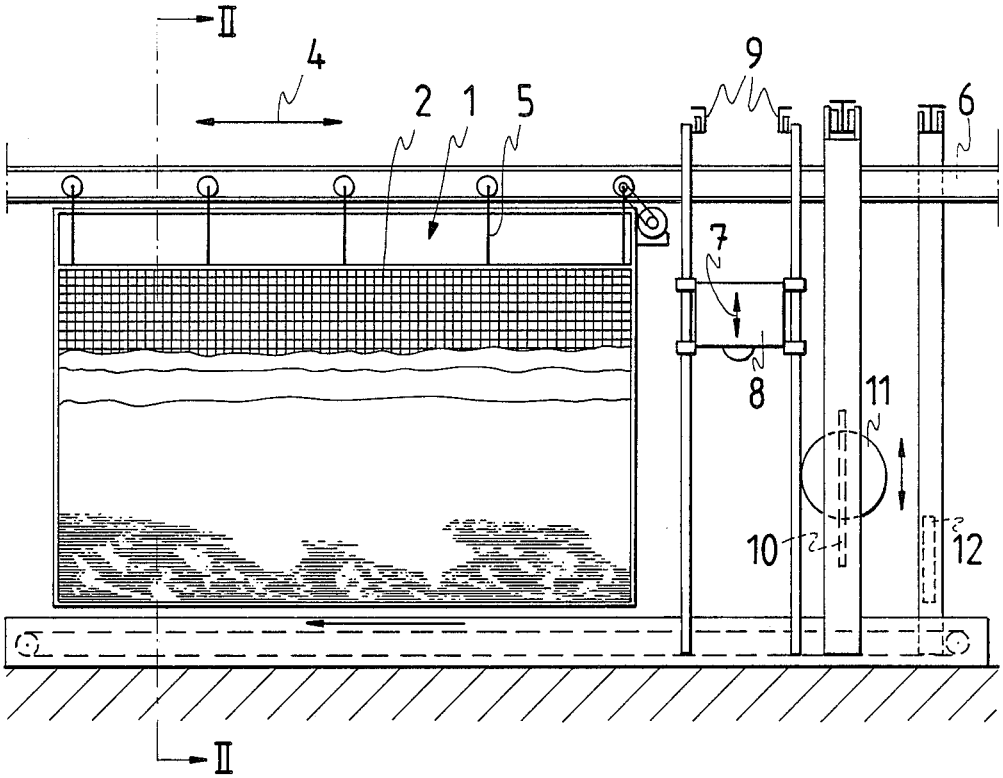
FIG. 1 illustrates the procedure for the production of concrete elements and the apparatus implementing it, seen from the side.
Figure 2:
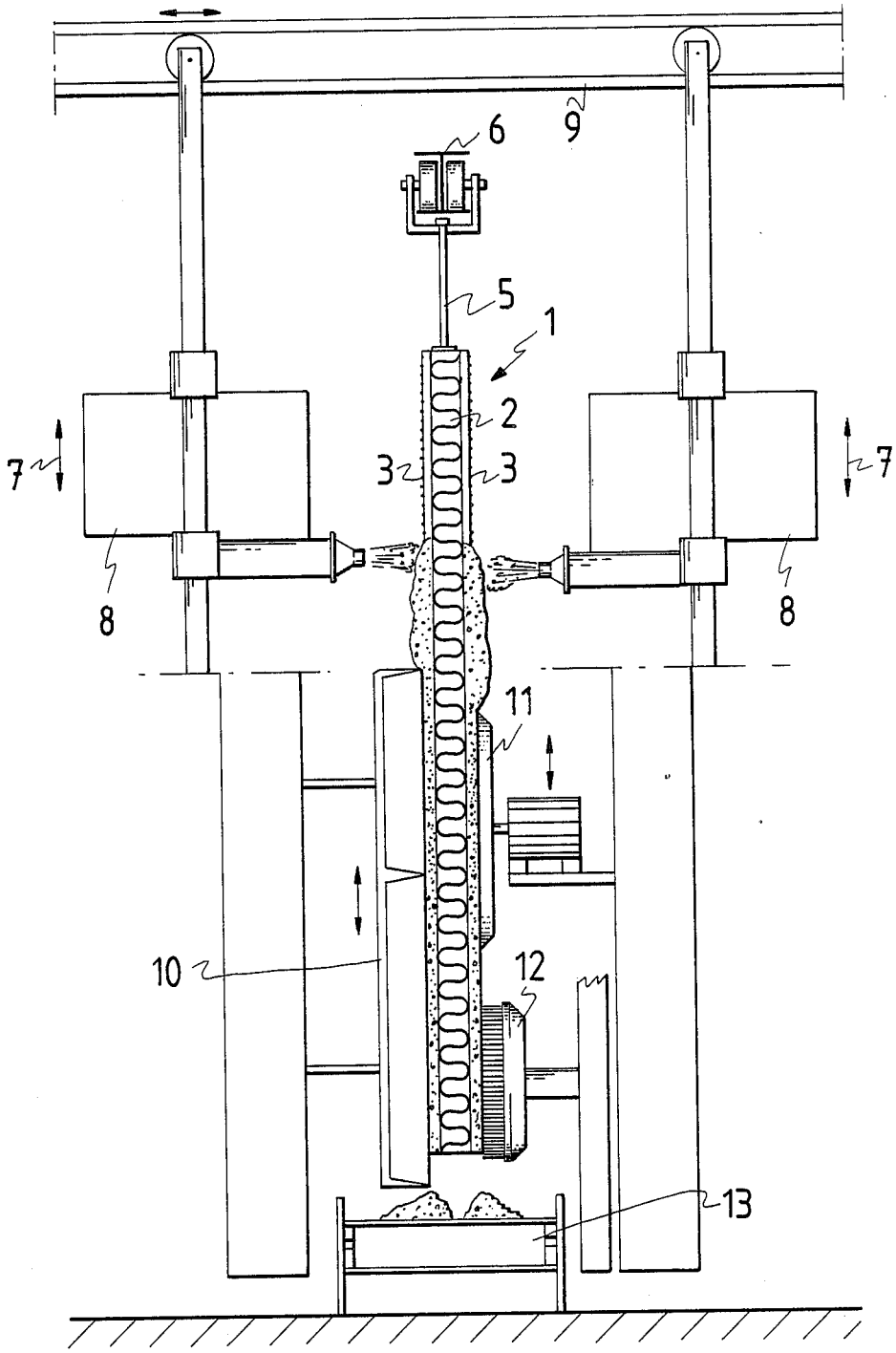
FIG. 2 shows a section through FIG. 1 along the line II—II.
Figure 3:
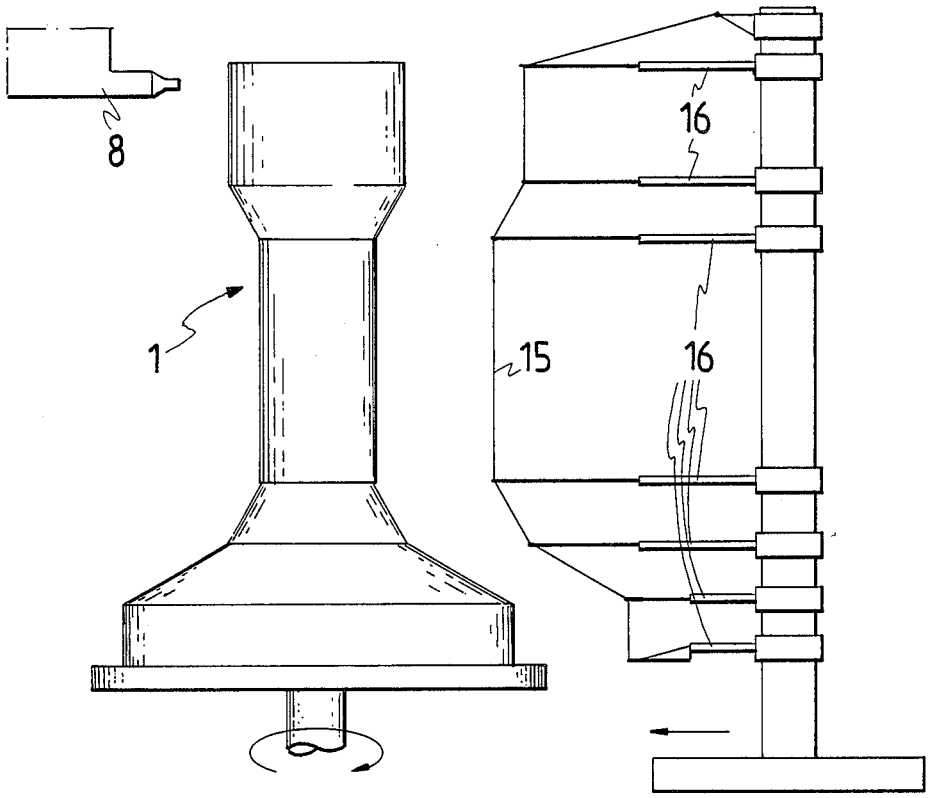
FIG. 3 illustrates the surface treatment of an element of a circular form.
Figure 4:
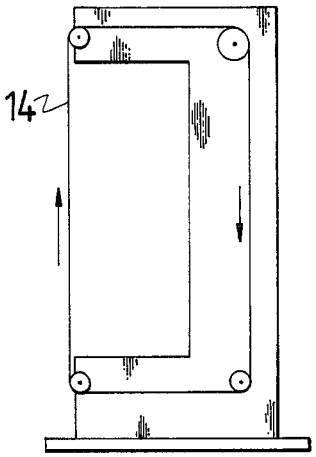
FIG. 4 represents a bandsaw-type concrete incisor.

By the present procedure, the concrete element is produced by shotcreting a vertically oriented wall structure 1 consisting of a board 2 of insulating material provided with concrete reinforcement 3 on its surface. The wall structure 1 is moved back and forth as shown by the arrow 4 while fresh concrete is sprayed directly onto the wall structure 1 by a shotcrete gun 8 moving in the vertical direction as shown by the arrow 7. The wall structure 1 is suspended from rails 6 by means of supporting arms 5. The shotcrete gun 8 is moved along separate rails at right angles to the direction of movement of the wall structure. After the shotcreting, the fresh concrete surface of the element is treated with an incisor 10, a rotating lapping disc 11 or a brush 12 as required. Below the element is a belt conveyor 13 placed so that it will receive and take away the superfluous fresh concrete falling down during shotcreting and surface treatment. In FIGS. 3 and 4, the incisor consists of a tightened band 14 or wire 15 which is vibrated or run around a continuous track as in a bandsaw when the concrete surface is being cut. The form of the cutting edge of the incisor in FIG. 3 can be adjusted by means of intermediate supports 16 e.g. to shape a column.

It is obvious to a person skilled in the art that the invention is not restricted to the examples described above, but that it may instead be varied in the scope of the claims to follow. Thus the procedure may employ e.g. profiling tools to produce brick wall patterns or the like. The incisor may also consist of a rigid straight plate with a knife-like sharpened edge, which can also be bent into a desired form.

I claim:

1. A method for the production of concrete elements comprising the steps of:

providing a wall structure having a surface, said wall structure being a sheet of insulating material having concrete reinforcement on said surface;

placing said wall structure in a vertical position, said wall structure being capable of lateral movement in a horizontal direction;

moving said wall structure laterally back and forth in front of a shotcrete gun while said shotcrete gun is moving up and down in a vertical direction;

spraying fresh concrete onto said surface of said laterally moving wall structure with said vertically moving shotcrete gun; and smoothing said fresh concrete, which was sprayed onto said surface of said laterally moving wall structure, by verically moving mechanical means to form said concrete elements.

2. A method for the production of concrete elements as claimed in claim 1 further comprising the steps of:

suspending said wall structure from a first set of rails with supporting arms;

moving said wall structure along said first set of rails back and forth in said lateral direction.

3. A method for the production of concrete elements as claimed in claim 2, further comprising the step of:

moving said shotcrete gun on a second set of rails in a direction perpendicular to said lateral direction of motion of said wall structure, toward and away therefrom.

4. A method for the production of concrete elements as claimed in claim 1 wherein said smoothing step is performed with an incisor, said incisor moving vertically while said wall structure is moving laterally.

5. A method for the production of concrete elements as claimed in claim 4 wherein said incisor is a taut elongated member having an upper end and a lower end.

6. A method for the production of concrete elements as claimed in claim 5 wherein said taut elongated member has a preselected profile, said profile being adjusted by means of at least one intermediate support between said upper end and said lower end.

7. A method for the production of concrete elements as claimed in claim 1 wherein said smoothing step is performed with a rotatable lapping disc, said rotatable lapping disc moving vertically while said wall structure is moving laterally.

8. A method for the production of concrete elements as claimed in claim 1 wherein said smoothing step is performed with a brush, said brush moving vertically while said wall structure is moving laterally.

9. A method for the production of concrete elements as claimed in claim 1 further comprising the step of:

placing a conveyor belt below said wall structure to receive and to remove fresh concrete which falls from said wall structure during said spraying and smoothing steps.

* * * * *